US006361357B1

(12) United States Patent
Stillwell et al.

(10) Patent No.: US 6,361,357 B1
(45) Date of Patent: Mar. 26, 2002

(54) REMOTELY ILLUMINATED ELECTRONIC CONNECTOR FOR IMPROVING VIEWING OF STATUS INDICATORS

(75) Inventors: Kaylene C. Stillwell; Jon A. Nelson, both of Magna, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/548,412

(22) Filed: Apr. 13, 2000

(51) Int. Cl.[7] ..... H01R 3/00
(52) U.S. Cl. ..... 439/490; 362/26
(58) Field of Search ..... 439/490; 362/26, 362/30, 31, 32; 340/815.42–815.47

(56) References Cited

U.S. PATENT DOCUMENTS

| | | | | |
|---|---|---|---|---|
| 2,916,720 A | | 12/1959 | Steans | 339/91 |
| 4,186,988 A | | 2/1980 | Kobler | 339/176 MP |
| 4,241,974 A | | 12/1980 | Hardesty | 339/154 A |
| 4,303,296 A | | 12/1981 | Spaulding | 339/112 R |
| 4,352,492 A | | 10/1982 | Smith | 273/1 |
| 4,407,559 A | | 10/1983 | Meyer | 339/126 R |
| 4,428,636 A | | 1/1984 | Kam et al. | 339/97 P |
| 4,564,728 A | | 1/1986 | Romano | 179/175.3 |
| 4,620,070 A | | 10/1986 | Ruehl | 179/175.3 |
| D291,071 S | | 7/1987 | Breil | D10/78 |
| 4,710,136 A | | 12/1987 | Suzuki | 439/374 |
| 4,778,410 A | | 10/1988 | Tanaka | 439/676 |
| 4,915,648 A | | 4/1990 | Takase et al. | 439/490 |
| 5,035,641 A | | 7/1991 | Van-Santbrink et al. | 439/329 |
| 5,051,099 A | | 9/1991 | Pickles et al. | 439/108 |
| 5,139,439 A | | 8/1992 | Shie | 439/359 |
| 5,183,404 A | | 2/1993 | Aldous et al. | 439/55 |
| 5,184,282 A | | 2/1993 | Kaneda et al. | 361/395 |
| 5,336,099 A | | 8/1994 | Aldous et al. | 439/131 |
| 5,338,210 A | | 8/1994 | Beckham et al. | 439/131 |
| 5,391,094 A | | 2/1995 | Kakinoki et al. | 439/638 |
| 5,411,405 A | | 5/1995 | McDaniels et al. | 439/131 |
| 5,481,440 A | * | 1/1996 | Oldham et al. | 362/32 |
| 5,481,616 A | | 1/1996 | Freadman | 381/90 |
| 5,499,923 A | | 3/1996 | Archibald et al. | 439/26 |
| 5,505,633 A | | 4/1996 | Broadbent | 439/329 |
| 5,509,811 A | | 4/1996 | Homic | 439/55 |
| 5,513,373 A | | 4/1996 | Damkier | 395/836 |
| 5,521,725 A | * | 5/1996 | Beeson | 362/31 |
| 5,538,442 A | | 7/1996 | Okada | 439/676 |
| 5,547,401 A | | 8/1996 | Aldous et al. | 439/676 |

(List continued on next page.)

FOREIGN PATENT DOCUMENTS

| | | | |
|---|---|---|---|
| DE | 3703423 | * | 8/1988 |
| JP | 61-256850 | | 11/1986 |
| WO | WO 95/13633 | | 5/1995 |

OTHER PUBLICATIONS

P.E. Knight and D.R. Smith "Electrical Connector for Flat Flexible Cable," IBM Technical Disclosure Bulletin, vol. 25, No. 1, Jun. 1982.

*Primary Examiner*—Neil Abrams
(74) *Attorney, Agent, or Firm*—Workman, Nydegger & Seeley

(57) ABSTRACT

This is a system and method by which the light from a light source on a selectively attached portable expansion device, such as a PCMCIA card, is more visible to a user. It is accomplished by using a light transfer medium, such as transparent plastic, in the plug of a media cable. The light transfer medium is molded in such a way to continue the path of light from the connector interface into the plug of the media cable. Inside the plug the light reflects off of a molded reflector in an upward and outward direction. The light can then be viewed through a transparent opening or viewing window, which may be bubbled or rounded to increase the overall viewing angle. Thus, it is an overall object of the present invention to provide an electrical connector that has a low physical profile but a high optical profile and is particularly useful in devices and peripherals implemented in reduced-size form factors, such as PC cards, compact flash cards or other removable media.

7 Claims, 4 Drawing Sheets

U.S. PATENT DOCUMENTS 5,561,727 A 10/1996 Akita et al. ..... 385/88
5,562,504 A 10/1996 Moshayedi ..... 439/638
5,608,607 A 3/1997 Dittmer ..... 361/686
5,634,802 A 6/1997 Kerlaan ..... 439/131
5,646,816 A 7/1997 Alden et al. ..... 361/622
5,660,568 A 8/1997 Moshayedi ..... 439/654
5,667,395 A 9/1997 Okada et al. ..... 439/131
5,679,013 A 10/1997 Matsunaga et al. ..... 439/144
5,692,914 A 12/1997 Mitani et al. ..... 439/131
5,727,972 A 3/1998 Aldous et al. ..... 439/655
5,741,152 A 4/1998 Boutros ..... 439/490
5,767,623 A 6/1998 Friedman et al. ..... 313/509
5,773,332 A 6/1998 Glad ..... 439/344
5,790,041 A 8/1998 Lee ..... 340/815.45
5,797,771 A 8/1998 Garside ..... 439/610
5,816,832 A 10/1998 Aldous et al. ..... 439/131
5,876,239 A 3/1999 Morin et al. ..... 439/490
5,885,100 A 3/1999 Talend et al. ..... 439/490
6,159,037 A * 12/2000 Madsen et al. ..... 439/490
6,229,585 B1 * 5/2001 Yanagi ..... 362/31
6,257,906 B1 * 7/2001 Price et al. ..... 439/490

* cited by examiner

REMOTELY ILLUMINATED ELECTRONIC CONNECTOR FOR IMPROVING VIEWING OF STATUS INDICATORS

BACKGROUND OF THE INVENTION

1. The Field of the Invention

The present invention relates generally to electrical connectors. More particularly, embodiments of the present invention relate to an improved electrical connector plug that provides for increased visual recognition of line status.

2. The Prior State of the Art

The demand for laptop personal computers and related equipment continues to expand due to a number of factors. One important factor is the portability and flexibility of laptop computers. Laptop computers allow commercial and non-commercial users to conduct business at remote or mobile locations with performance comparable to desktop workstations. A related factor to the increased demand is the recent affordability of laptop computers in that the prices of computers continue to decline making them readily available for business users. Another factor is the expansion and development of the Internet and related network communications. More and more commercial and non-commercial enterprises are conducting business via the Internet and consumers need personal computers to gain access to the products and information that are available on the Internet. In essence, the laptop computer allows the user to access the resources available on the Internet via remote connections to a communication network.

In addition to being more portable and affordable, advances in computer application software, operating systems, and communications software fuel the development of computers with greater processing speeds and capacities. At the same time, the pressure to at least maintain, or preferably reduce, the physical size of the laptop computer increased as well. Accordingly, downsizing and miniaturization of computer components is an issue of great importance in the industry.

In an effort to reduce the physical dimensional characteristics of the typical personal computer, and yet expand the capabilities of that computer, manufacturers began to develop miniature portable expansion devices having smaller sizes, such as add-on memory cards and modems. The typical expansion device was designed to plug into a port or socket on the main computer; thus the expansion device served to expand the capability of the computer without significantly increasing the size of the laptop computer.

While the development of portable expansion devices represented a significant advance in the capabilities of personal computers, one drawback to many of these devices was that they were designed to fit only one manufacturer's computer, and thus were not interchangeable between platforms. Other devices, such as serial port devices, were often limited by the speed of the underlying communication protocol or the physical limitation imposed by the limited number pins used for each port.

The industry recognized that standardization of these devices would, among other things, greatly increase the demand for them. To this end, several manufacturers collaborated to form the Personal Computer Memory Card International Association (PCMCIA). This body developed and promulgated standards for the physical design, dimensions, and electrical interface of expansion devices. Specifically, the PCMCIA PC Card standard identifies three primary card types: Type I, II, and III. These PC Card types correspond to physical dimension restrictions of 85.6 mm (length)×54.0 mm (width). Type I PC Cards have a further dimensional restriction regarding thickness of 3.3 mm. Type II PC Cards allow device thickness of up to 5.0 mm. And Type III PC Cards allow a thickness of 10.5 mm. Now, many computers being manufactured, especially those having a reduced size, are adapted to accommodate these standards. Laptop computers, in particular, are increasingly popular for both business and personal applications due in part to the development of PC Card peripheral devices designed to increase the functionality of the computers. As an example, PC cards are commonly used with portable and desktop computers to provide added features and/or functions. For instance, PC cards are often configured to function as a memory card, a network interface card, a sound card, a modem, or other device supplying add-on functionality.

PC cards have become very popular because of their relatively small size, interchangeability, and capability. However, as a result of the relentless drive for smaller and more capable computers, the industry has developed a new generation of expansion devices with an even smaller "form factor" or physical size than that of PCMCIA cards. The new expansion devices, or cards, are sometimes referred to as "compact flash" or "miniature flash" cards. A typical compact flash card uses about 1550 $mm^2$ (36 mm long×43 mm wide) of space on a circuit board. In contrast, a typical card built to PCMCIA standards uses almost three times as much circuit board space, or about 4644 $mm^2$ (86 mm long×54 mm wide). Some examples of the devices developed for the new compact flash cards include modems, local area network (LAN) cards, and compact flash memory cards, which are solid-state storage devices that may have a storage capacity as high as 40 MB.

Clearly, the PC card, compact flash card, and other portable expansion devices represent an important advancement in the art. However, the size of these cards creates some new problems that must be overcome for the maximum performance and reliability. Certain of these problems are particularly acute in connector interfaces between external cables and the portable expansion device. Some of the problems flowing from the use of the new form factor concern the physical and electrical interfaces between the PC card and the various types of media cables used to carry media between the PC card and other devices. For example, it is often difficult to discern whether a cable attached to a connector plug is properly connected to a connector socket on the PC Card. To assist with this and other communication problems many PC Cards place an indicator close to the connector socket to show the presence or lack of data or communications traffic across the connector interface. This indicator may be a LED, light pipe, or other light source that is used to visually depict PC Card device or line status.

Presently, it is awkward and difficult for the laptop user to see the device or line status indicator on a portable expansion device, such as a PC Card product. An interested user is required to look around the edge of the laptop computer or to change the operating position of the computer in order to view the device or line status indicator. Because of the previously mentioned connector interface problems related to the size of the portable expansion device, the user risks damaging or disconnecting the attached power and communication cables if the operating position of the computer is altered. Even worse, the interested user risks losing unsaved data that is being transmitted or received by inadvertently disrupting one of the cables connected to the laptop. The two main problems for the status indicator are the location and the size of the viewing area of the status indicator.

As suggested earlier, some of the problems flowing from the new form factor relate to the type of physical/electrical interface used to connect a communication cable to the card. In particular, the presence of data flowing through the communication cable via the physical/electrical interface and I/O connector plug and socket is not easily observable from the standard operating position of the laptop user. Many of the connectors currently in use with the expansion cards, including the multiple pin connectors used for modem and NIC cards, lack any device or means to reflect the indicator signal produced by the cards to the user. Thus, when a connector plug at the end of the communication cable is inserted into the card connector socket, the indicator signal that is produced as a result of data flow through the connector is not reflected or easily visible to the user. What is needed is a connector interface that is easily visible to a user using a laptop computer in a standard operating position.

Not only are the typical portable expansion card I/O connector designs ineffectual in providing increased visual recognition to the user, those connectors which do extend the indicator signal from the card generally require extra wiring for an extended light source, thereby increasing the complexity of the connection and decreasing the reliability. Often a cable connector adapter or Dongle, after the way it dangles out of a portable expansion card, will be fitted with indicator light emitting diodes, but this configuration is problematic as the LED leads must be soldered to an internal printed circuit board or to terminals on the connector. Over time these solder joints become subject to shorts and the indicator reliability is dramatically reduced. Furthermore, the LED leads must be sleeved to prevent shorting and shielded to avoid interference with the data signals of the cable connector adapter. Illumination devices placed in close proximity to the cables or analog circuitry can create noise that interferes with the analog signal thereby lowering signal quality and integrity. What is needed is a reliable illuminated connector interface that does not interfere with the signal quality.

When LEDs and other illumination devices are placed within and adjacent to modem and network adapter connectors they are typically in close proximity to the analog circuitry required to process data received from phone lines and other signals. These light sources may be located on the peripheral device or on a double type connector. These illumination devices can create noise, which interferes with the analog signal lowering signal quality and integrity. For this reason, it is desirable to segregate illumination devices from the analog circuitry to avoid noise interference. This is often achieved by keeping illumination devices physically separate from analog circuitry. FCC, Part 68 defines minimum distance separation standards for achieving this segregation. While physical separation negates the effects of the noise emitted by illumination devices and other circuitry, it utilizes a great deal of space on the circuit board that could otherwise be occupied by device circuitry. The result is wasted space on the circuit board and a larger electronic device. What is needed is a means for remotely locating illumination devices such as LEDs while directing the light through areas of sensitive circuitry to a connector or other area visible to the user.

In view of the foregoing problems with miniaturized peripherals, such as PCMCIA PC cards and compact flash cards, and their associated connectors, what is needed is an improved illuminated connector that can be used with portable expansion devices, such as LAN cards and modem cards. Specifically, the connector should be able to reflect and/or illuminate a visible indicator or viewing window with remote luminous energy produced by the connector or attached portable expansion device.

SUMMARY OF THE INVENTION

The present invention has been developed in response to the current state of the art, and in particular, in response to these and other problems and needs that have not been fully or completely solved by currently available connectors. Thus, it is an overall object of the present invention to provide an electrical connector that has a low physical profile but a high optical profile and is particularly useful in devices and peripherals implemented in reduced-size form factors, such as PC cards, compact flash cards or other removable media. More specifically, the present invention relates to a functionally illuminated connector interface facilitating mechanical, electrical, and optical connections using plug and socket type connectors between two electronic devices.

One advantage of the present invention is to provide functionally illuminated connector plugs that show data as communication traffic across the connector interface via a remotely activated indicator or viewing window.

Another advantage of the present invention is the use of an axially located viewing window on the connector plug, thereby providing clear visibility to a user operating a laptop computer in a standard operating position.

Yet another advantage of the present invention is reduced signal interference and increased reliability of the connector due to the separation of the light source from the analog circuitry via integrated light transfer media.

Another advantage of the present invention is energy conservation and enhanced visibility of a line status indicator through optical manipulation of a remotely generated light signal.

In summary, the foregoing and other objects, advantages and features are achieved with an improved connector for use in connecting media cables and the like to reduced-size peripherals implemented within PCMCIA PC cards, compact flash cards and the like, such as modems, peripheral controllers, and network interface cards (NICs). Embodiments of the present invention are particularly suitable for use with such peripherals that are used in a typical laptop personal computer (PC) having one or more sockets or bays designed to accommodate PCMCIA PC cards or compact flash cards. For example, a PC card having the illuminated I/O interface is inserted into the socket or bay in such a way that the illuminated connector interface on the PC Card is readily accessible for insertion of a remotely illuminated electronic connector plug or the like therein. In a preferred embodiment, a PC card having LAN or WAN functionality includes a connector interface, wherein the connector interface comprises a socket, a light source, and a communication interface with I/O pins. The connector interface preferably defines a socket to receive a remotely illuminated connector plug.

Typically, such devices find particular application in portable computing equipment, such as laptop or notebook computers, handheld computers, personal organizers, or similar miniaturized devices. However; the present invention may also be applied to other electronic receptacles, such as a television socket or jack, a stereo sound system socket, an antenna socket, a speaker socket, a cable socket, a VCR socket, a RGA socket, a video game socket, a telephone socket, a computer Ethernet connection socket, a modem socket, or other peripheral socket.

The present invention provides a remotely illuminated connector plug that functionally illuminates an indicator window using a high luminescence and light dispersion transfer medium without imposing the disadvantages of unnecessary light source circuitry on the plug. Illumination of an axial located viewing window may be achieved by selective placement of light receivers on the plug to focus light from an external light source through a light transfer medium, such as a light pipe, to the viewing window. In one embodiment the entire connector plug may be configured with reflective or refractive surfaces in order to achieve local illumination of the connector plug for a diagnostic and product identification display to the user. The utilization of light transfer media, particularly light pipe conduits limit signal interference.

Embodiments of the present invention overcome the electrical, optical, and mechanical challenges presented by the laptop connection to a communication network, or similar types of connector interfaces. Also, presently preferred embodiments can be integrated or incorporated with other connector interfaces to eliminate external indicators and standardize connector plugs. Moreover, the reliability of the connector plug increased by taking advantage of light transfer mediums and eliminating individually soldered joints generally associated with an external light source, thereby lowering the overall cost and complexity of the connecting device or connector plug.

Additional objects and advantages of the invention will be set forth in the description which follows, and in part will be obvious from the description, or may be learned through the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained, a more particular description of the invention briefly described above will be rendered by reference to specific embodiments thereof, which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Devices that connect or interface with a communication network are generally designed to transmit and receive signals from the network via a media cable. The most prevalent method of attaching the media cable to the device is through a connector interface comprising a socket and plug interface. An indicator that shows the presence of traffic across the connector interface is often placed close to the plug and socket.

Figure 1:
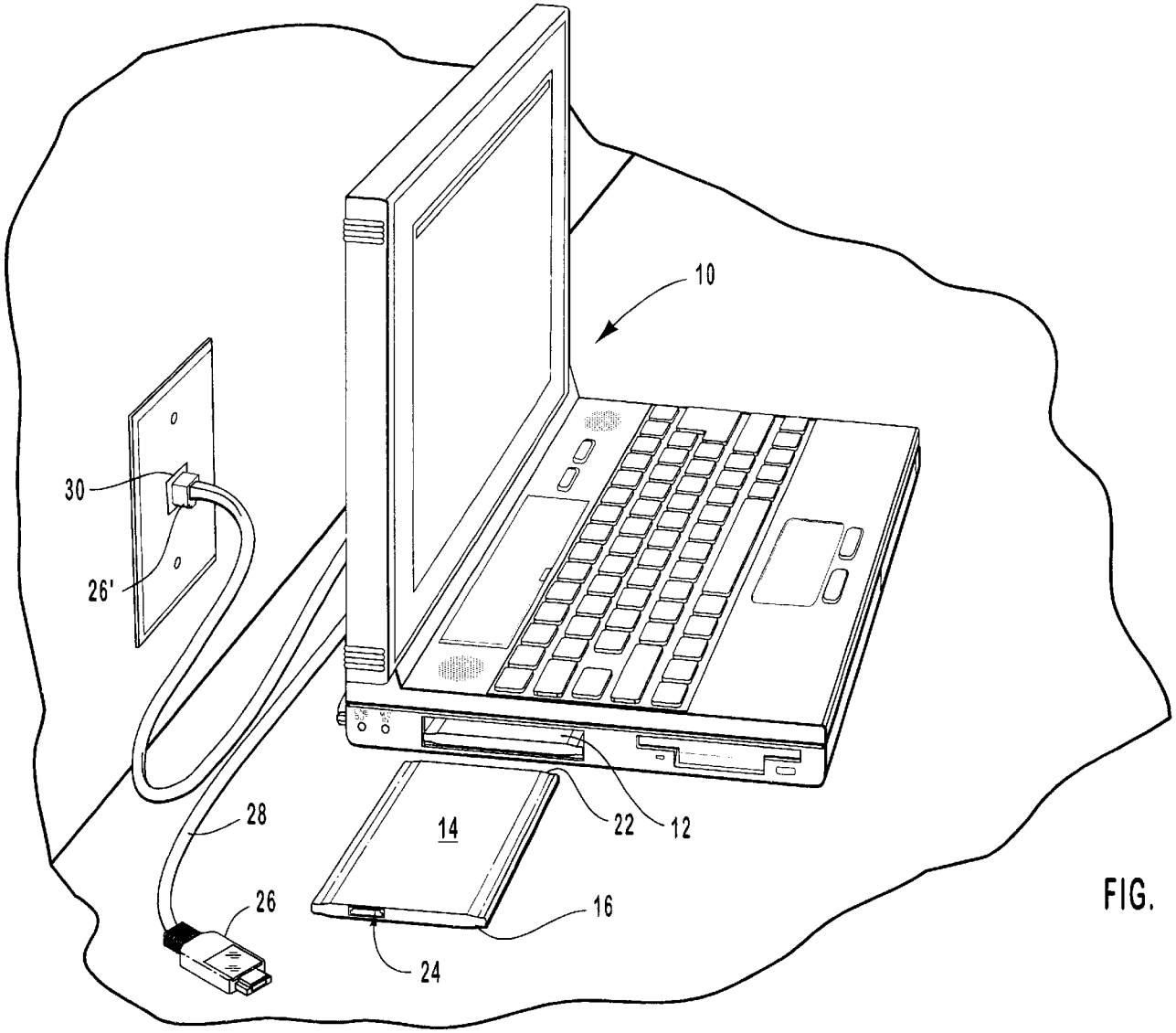
FIG. 1 illustrates an exemplary system that provides a suitable operating environment for the present invention.

Reference is first made to FIG. 1, an exemplary system or environment in which the present invention may be utilized or implemented. FIG. 1 is intended to be illustrative of potential systems that may utilize the present invention and is not to be construed as limiting. The system of FIG. 1 illustrates a portable computer 10 having a portable expansion slot 12 that is configured to receive a miniature portable expansion device 14.

Exemplary upgrade modules, portable expansion devices, or profile cards include devices such as solid-state interface cards, PCMCIA (Personal Computer Memory Card Association) PC Cards, ATA (Advanced Technology Attachment) cards, Compact Flash cards, SmartMedia cards, SSFDC (Solid State Floppy Disk Cards), or other miniature expansion card device. Expansion slots 12 allow for insertion of the aforementioned upgrade modules into standard compatible slot interfaces, such as the PCMCIA PC Card standard that identifies three primary card types: Type I, II, and III.

The portable expansion device 14 may be a modem, a network interface card, or any other card. The interface 22 of expansion device 14 is configured to detachably connect with a high-speed connector (not shown) inside slot 12. Inserting expansion device 14 in slot 12 permits expansion device 14 to be in electrical and physical communication with computer 10.

The expansion device 14 includes a connector socket 24 which is illustrated as an AC820 compliant socket, but may be any type, including but not limited to, propriety based multiple pin connectors, 15-pin connectors, RJ type connectors, or coaxial cable connectors. The terms connector socket, miniature modular jack, physical/electrical media connector, fixed jack, XJACK®, alligator jack, and the like, connote a media connector that may have qualities such as those connectors having physical attributes described in FCC Part 68, Subpart F. Specific terms such as RJ-type, RJ-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors. This is particularly true as many of the aforementioned connector sockets do not presently provide optical coupling as required by the present invention, and would require modifications to appropriately practice the invention.

The connector socket 24 is configured to removably receive connector plug 26 that is connected to one end of media cable 28. The connector socket 24 preferably defines a cavity that receives a portion of the connector plug 26. The socket 24 is preferably shaped so as to preclude insertion of electrically incompatible connector plugs. This feature prevents the inadvertent attachment of plugs that contain electrical signals that could damage electronics within the card. This feature also precludes insertion of inverted connector plugs. The connector socket 24 further comprising a retention mechanism, and the force imposed thereby, provides tactile and audible feedback to notify the user when the connector plug 26 has been securely received within connector socket 24. The connector socket 24 and retention mechanism is fashioned to mechanically fasten the connector plug 26 in the proper place. When properly seated, the connector interface 16 of the present invention automatically aligns the light source of the connector interface 16 with an appropriate light transfer medium in the connector plug 26.

The other end of media cable 28 is connected to connector plug 26', which is capable of selectively connecting with jack 30. Jack 30 is typically connected to a communication network, such as a telephone network, LAN, private branch exchange (PBX) system, or any type of computer network. Alternatively, jack 30 may be connected to a peripheral device, such as a scanner or SCSI hard drive array, controlled or driven by computer 10 via portable expansion device 14.

Figure 2:
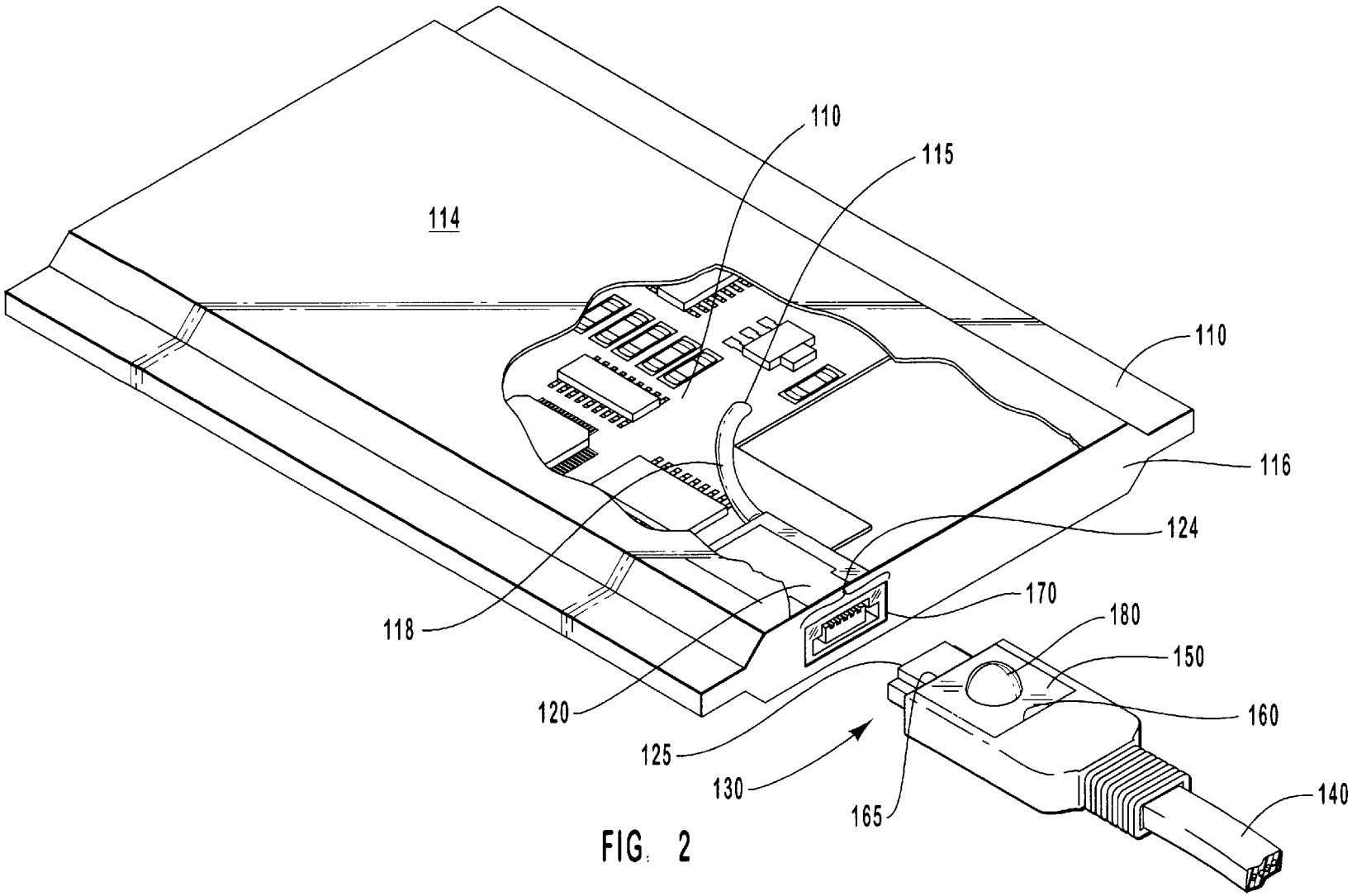
FIG. 2 is an exemplary connector interface illustrating a suitable socket and plug for the present invention.

With reference to FIG. 2, an exemplary connector interface illustrating a suitable socket and plug combination for the present invention, a connector interface 116 for electronically, optically, and mechanically coupling a communication cable plug 130 to a selectively removable peripheral device 114, such as a PC card, housed within a host computer in a peripheral slot, such as a PCMCIA slot. The connector interface 116 consists of a socket 124 and indicator interface 170 located on PC card 114. The connector interface 116 further comprising a connector plug 130 attached to communication cable 140 inserted into socket 124. A selectively detachable connector assembly electrically and mechanically couples the cable and connector to the socket or media plug, more importantly however; the connector plug 130 optically aligns the light transfer medium 165 with an indicator interface 170 located on the exposed end of the PC card 114. Optical alignment between the indicator interface 170 and the light transfer medium 165 allow at least a fraction of the light emitted from the light interface to be transferred through the medium to a reflector 160. Exemplary reflectors include a molded reflector, prisms, mirrors, flexible light fibers, or other reflective material useful for redirecting the input light. The light transfer medium 165 may consist of a transparent plastic material, a fiber optic cable, a light pipe, or other means of directing light in the direction of reflector 160. Reflector 160 focuses the light to a transparent opening or viewing window 150. Within the connector plug 130 the light is reflected off of the molded reflector 160 in an upward and outward direction. Amplified or focused in this manner the light is then viewable through viewing window 150. In some cases the clear flat surface of the viewing window 150 may also be a bubbled or rounded surface to increase the viewing angle of the transmitted light. An exemplary rounded embodiment is illustrated by indicator dome 180. Indicator dome 180 is the focal point of a majority of the redirected and reflected light from the light transfer medium 165. Indicator dome 180 disperses the light uniformly thereby providing the user with an axially located indicator for line and device status. One variation of the indicator dome 180 is a multiple feature indicator dome in which different colors may be reflected from different sources to the indicator dome 180 resulting in a variable colored indicator dome.

Preferably, connector socket 124 comprises a plurality of I/O pins and a molded interface for receiving connector plug 130. The I/O pins are secured to a printed circuit board (PCB) 110 enclosed within the housing of the PC card 114. When the connector plug 130 and socket 124 are properly secured, I/O pins in socket 124 and plug 130 will be in electrical communication with each other. In a preferred embodiment, a remotely illuminated electronic connector plug 130 is inserted into a connector socket 124, which is disposed between the external casings of the PC card 114. Portions of the I/O pins and connector socket 124 are secured to electrical contacts on the surface of the PCB 110, thereby ensuring physical contact and electrical communication between the connector and the PCB circuitry. The socket further comprises a plurality of resilient conductive members that function to maintain physical and electrical contact between the connector socket 124 and the top and bottom portions of the external casing of the PC card 114. Optical transmission via connector interface 116 must not interfere with the electrical communications and may require shielding within the light transfer medium 165 of the connector plug 130 and the indicator interface 170 of the PC Card 114.

A functionally illuminated connector plug 130 is a connector plug which, by way of simple illumination, specific illumination color, specific color combinations, intermittent illumination flashing patterns, color combination combined with flashing patterns or other illumination schemes, indicates an attribute of a device or system to which the connector plug is connected. One example of functional illumination, not to be construed as limiting the scope of the present invention, is a PC card LED indicator interface that contains two LEDs, typically of different colors. This type of connector interface is commonly used with a network adapter card where one LED is configured to illuminate thereby indicating that a signal is being received from the network while the second LED is configured to illuminate thereby indicating that network traffic or activity is present on the line. Another example of functional illumination, given by way of example and not limitation, is an illumination scheme used on some network adapters with optional topologies, such as a network adapter capable of providing access using speed or bandwidth topologies. These adapters may use a three LED scheme with one LED indicating network signal, another LED indicating a 10 Megabit per second capable connection, and the third LED indicating a 100 Megabit per second capable connection. Functional illumination may also indicate whether a card or peripheral device is inserted or connected properly. Functional illumination may also comprise illumination that indicates the location of the connector socket.

The connector interface 116 comprises a connector socket 124 and a light source or indicator interface 170. The indicator interface 170 is disposed between the external casings of the PC card in close proximity to the connector socket 124. A light source 115 for indicator interface 170 may include direct light from light emitting diodes, low power lamps, fluorescents, luminescents, or indirect light brought to the connector interface 116 via light transfer medium 120, such as a light pipe 118 or light reflective material. The indicator interface 170 may be suspended at the connector interface 116 or fixed to the connector socket 124. The close proximity of the indicator interface 170 to the connector socket 124 enables the remotely illuminated connector plug 130 to redirect the light via light transfer medium 65.

In the connector embodiment shown in FIG. 2, light source 115 radiates light into light pipe 118 that transmits the light to the rear surface of connector socket 124 where a receiver allows light to travel through light transfer medium 120 to indicator interface 170. Indicator interface 170 radiates light into a plug receiver that allows light to enter plug connector 130 and be transmitted via light transfer medium 165 to reflector 160. Reflector 160 focuses the light onto viewing window 150 and more specifically indicator dome 180 thereby illuminating viewing window 150 and indicator dome 180.

In a similar configuration of the connector embodiment, the light transfer medium 120 could accept light from a second light source. The second light source could radiate light into a second light pipe that either transmits the light to the first light receiver or to a second light receiver, which is a lens formed into backside surface of the light transfer medium 120. The second light receiver directs the light to a light redirector or interior light pipe which transmits or redirects the light to the front face of connector interface 116 where the light illuminates a selected section of the indicator interface 170 as a second functional indicator of the state or condition of the connection made with the PC Card 214.

The term light transfer medium as it is used in this document refers to any physical conduit which may transmit light from one end to the other by optically guiding light along its length. By way of example, but not limitation, a light pipe is an optical type of light transfer medium. Light pipes may have a solid or hollow cross-section and may have a round, square or other cross-sectional shape. Solid light pipes are composed of translucent, highly transparent material through which light may pass without appreciable transmission losses. By way of example and not limitation, light pipes may be composed of glass, polycarbonate or acrylic as well as many other materials. Hollow light pipes are typically constructed of highly reflective materials which reflect the light between interior surfaces, however, the interior surface of a hollow light pipe may also transmit light through a plurality of lenses which direct the light from the surface of the pipe back toward the center of the conduit. These lenses may vary in size from several inches to microscopic. Solid light pipes are typically coated with a reflective material to reflect light along the solid center conduit.

Light transfer medium may be rigid or flexible depending on the material used and the application. A light transfer medium is typically continuous and homogenous throughout its length, however, it may be formed by a series of lenses spaced apart and configured so as to redirect light to the next lens in the series. A light transfer medium may also be formed from a single light pipe conduit defined by a single outer reflective surface or a series of substantially parallel light pipe conduits forming a bundle. One example of the bundle type light pipe conduit is a typical fiber-optic cable bundle with a multiplicity of fibers capable of transmitting from one light source to a given destination. Both the bundle type conduit and the single conduit configurations work adequately in the present invention. For the application of the present invention, solid polycarbonate are the preferable light transfer medium for fixed connectors as the material is rugged and stable in the range of temperatures encountered in electronic equipment and transmits light with minimal losses. Flexible fiber-optic cables are preferred for retractable connector systems.

Due to the undesirable electromagnetic noise emissions from LEDs and associated circuitry in close proximity to analog circuitry, a preferred method of connector interface illumination utilizes remotely located light sources from which light is transmitted to the connector socket 124 using one or more light pipes 118. As a non-limiting example, remote light source 115 transmits light into light pipe 118, which may bend in any direction to accommodate the necessity of elements in its path, eventually arriving at light pipe terminal end which directs light into a light receiver 120 on the indicator interface 170 to be illuminated. Light source 115 may be any light source suitable for placement on a PCB such as an LED, a small incandescent or fluorescent lamp, or a lower-power laser. Light source 115 may also be place off the PCB at another location in an electronic device and may comprise an LED, incandescent lamp, fluorescent lamp, laser or other light emitter or collector.

Light pipe 118 may be a solid, continuous, polycarbonate rod as in the preferred embodiment or any alternative light pipe embodiment as know in the art or described above. Light pipe terminal end may be, for example, a solid, specially-polished termination of light pipe 118 as is known in the light pipe and fiber-optic art, or terminal end may form, as another example, a lens configured to transmit light into a light receiver 45. The light receiver is located in or attached to a translucent body that acts to capture light and direct that light to a designated target, such as indicator interface 170 and light transfer medium 165, which may be the receiving end of another light pipe or light transfer medium or it may be a light redirector 24 which may have one or more reflective or refractive surfaces for redirecting light to a specific location.

As shown in FIG. 2 light pipe 118 transmits light into transfer medium 120, which, in this example, is a polished, highly transparent surface which allows light emitted from light pipe 118 to strike reflective light redirector that directs the light longitudinally along the socket interior toward redirecting bevel face part of indicator interface 170 where the light exits thereby illuminating indicator interface 170 and any indicia thereon. Light transfer medium 165 then receives the light.

Figure 3:
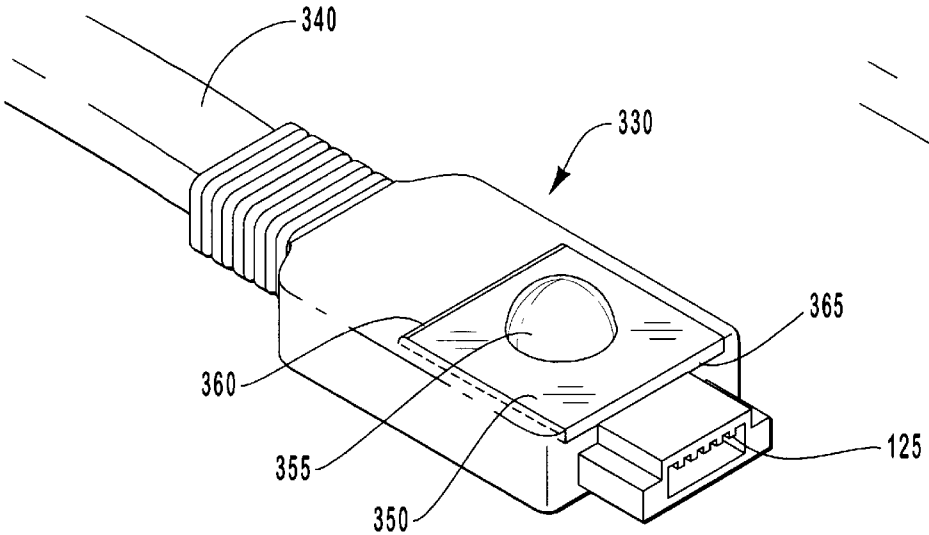
FIG. 3 illustrates a rounded viewing window on a remotely illuminated connector plug.

With reference to FIG. 3, viewing window 350 of connector plug 330 includes a bubbled or rounded viewing indicator window 355. The present invention relates to a connector plug 330 comprising one or more portions composed of translucent material that act as a light transfer medium 350 configured so as to be functionally illuminated by light directed to those portions of the connector plug 330 via one or more light interfaces 365 originating from a light source that may be located remotely from the connector plug 330 and associated analog circuitry associated with the peripheral device. Examples of a light source from which the light transfer medium 350 of the light interface 365 may originate, given by way of example and not limitation, may be an incandescent light, a Light Emitting Diode (LED) or a low power laser.

As applied to the computer industry, the present invention relates to a computer communication connector plug 330 configured for insertion into a socket, the plug comprising one or more portions of substantially translucent material or other light transfer medium 350. By way of example and not limitation this socket and plug interface may take the form of an AC820 type connector interface. The light transfer medium 350 is generally composed of substantially translucent material, preferably made of a unitary article such as a thermoplastic or a glass. By "unitary article," it is understood that the article is formed, molded, or machined from substantially a single piece of material. However, non-unitary articles also function effectively. The presently preferred material for the light transfer medium portions is ULTEM®, a polyetherimide made by GE plastics of Pittsfield, Mass. Other suitable materials include LEXAN 940A®, LEXAN 920®, and LEXAN 920A®, polysulphone, polyester, polyvinyl chloride (PVC), styrene acrylonitrile (SAN) and glass.

As the light is reflected from the reflector 360, it is focused on the indicator dome 355, in essence amplifying the bubbled or rounded area for easier observation by a laptop computer user. I/O pins 125 carry signals from the attached connector plug 330 to cable 340 without interference from the optical signals transmitted to reflector 360. The light transfer medium 350 may act as a waveguide to alter the optical signal in a manner that intensifies the optical signal dispersion at bubbled viewing window 355. The light transfer medium 350 may also shield the data signals being transmitted received through connector plug 330.

Figure 4:
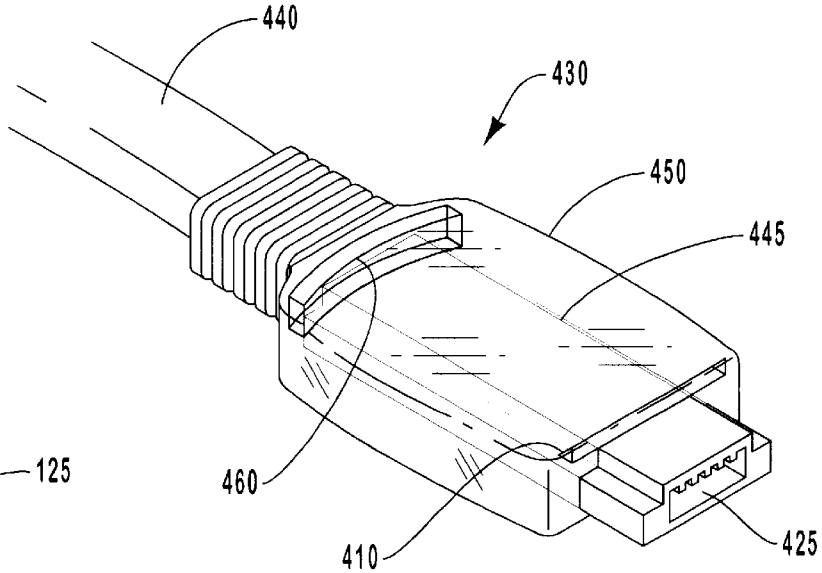
FIG. 4 illustrates a transparent connector plug.

Reference is next made to FIG. 4, which is an exemplary transparent connector. Transparent connector 430 contains a plug I/O interface with I/O pins 425 that facilitate transmission and reception of data via media cable 440 which passes through an optically shielded sleeve 445. The optical interface consists of a dispersion prism 410 located on the exposed connector plug end for interfacing with the light source of the expansion card. Dispersion prism 410 may refocus and intensify the light received from the light source and disperse the light signal or optical signal through the transparent connector 430. The external shell of the transparent connector 430 is beveled in a manner to reflect the optical signal and thereby increase the visual recognition of an individual looking at the transparent connector 430. Rounded Reflector 460 redirects reflected light back into the transparent connector 430.

Figure 5:
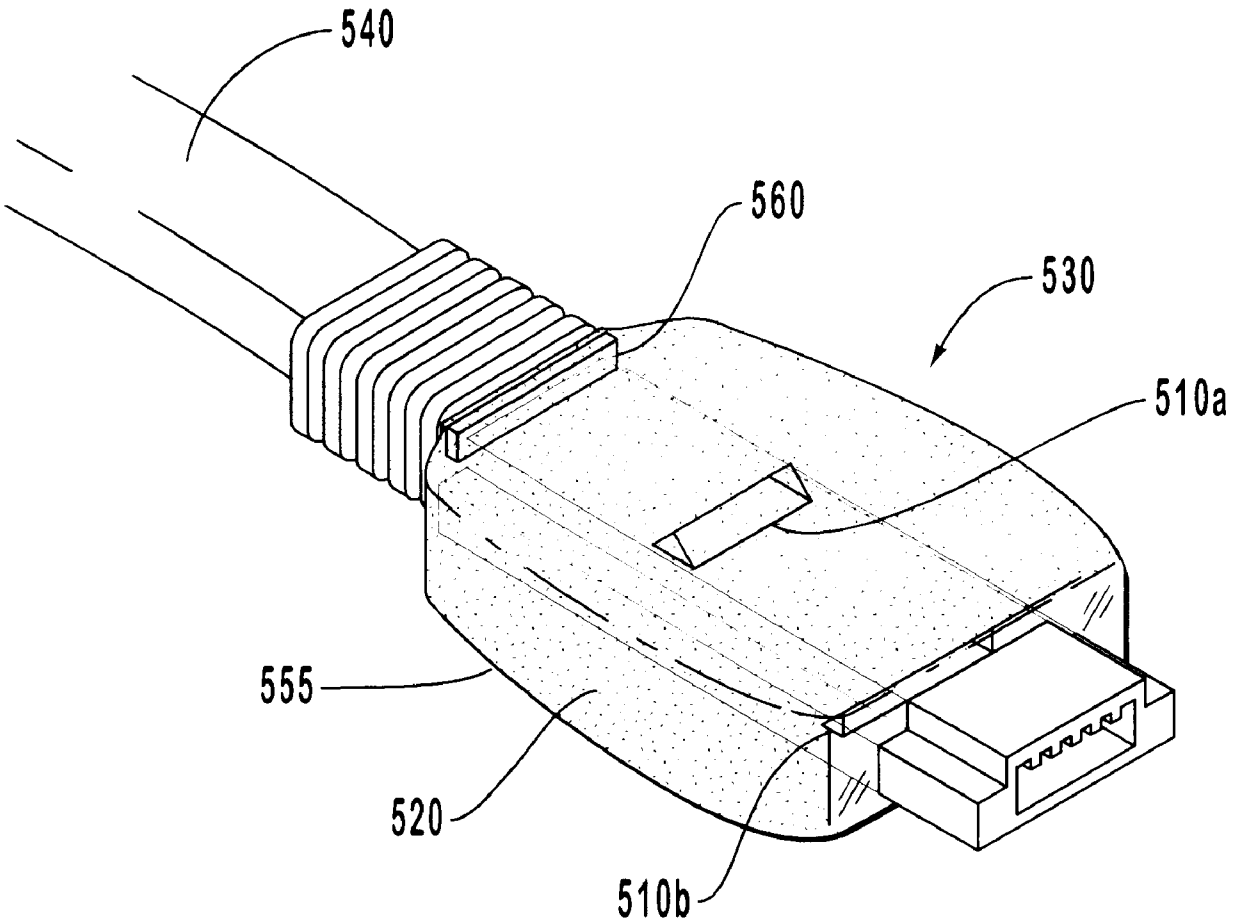
FIG. 5 illustrates a transparent bubbled connector plug.

Reference is now made to FIG. 5, an embodiment encompassing the advantages of a bubbled viewing angle and a transparent connector. An optical signal enters the transparent bubble connector 530 via dispersion prism 510*b* which redirects and focuses the light to the central dispersion prism 510*a* which reflects the optical signal via the light transfer medium 520 to the bubbled viewing window 555 which encompasses the entire transparent bubbled connector 530. A curved reflector 560 located in the proximity of the media cable connection 540 reflects any residual optical signal back towards the direction of the dispersion prism 510*a*. The communication cables pass through the center of the transparent bubble connector 530 and may be shielded through the standard wire coating.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A connector system for coupling a cable to a host device, the connector system comprising:

a light source disposed within the host device, the light source being capable of emitting a light signal;

an electrical connector having a socket, the electrical connector further including a light conducting portion that is optically coupled to the light source and that is capable of conducting at least a portion of the emitted light signal to a light emitting surface disposed along the majority of an outer periphery of the socket; and a plug having a body disposed on an end of the cable, at least a portion of the plug capable of being operably received within the socket so as to provide an electrical connection between the cable and the host device, wherein the plug further comprises:

an optical conducting portion defining a light conducting path within the plug body, the optical conducting portion being optically coupled with the light emitting surface when the plug is operably received within the socket so as to conduct the light signal emitted therefrom;

at least one viewing portion positioned on the plug so as to emit at least some of the light signal received by the optical conducting portion for visual inspection; and at least one reflector, positioned so as to reflect at least some of the light signal present within the optical conducting portion substantially towards the at least one viewing portion.

2. The connector system of claim 1, further comprising at least one optical dispersion member disposed at a point along the light conducting path.

3. The connector system of claim 2, wherein the optical dispersion member is a prism.

4. The connector system of claim 1, wherein the at least one viewing portion is substantially planar with an outer surface of the plug.

5. The connector system of claim 1, wherein the at least one viewing portion includes a rounded surface.

6. The connector system of claim 1, wherein the emitted light signal indicates an operations status of the host device.

7. The connector system of claim 1, wherein the host device is a device conforming with the physical and electrical requirements of the PCMCIA standard.

* * * * *